United States Patent [19]

Weimer, Jr.

[11] Patent Number: 4,583,678

[45] Date of Patent: Apr. 22, 1986

[54] BOTTOM SPEED LOCK FOR CONTAINER

[75] Inventor: Charles P. Weimer, Jr., Danielson, Conn.

[73] Assignee: International Paper Company, New York, N.Y.

[21] Appl. No.: 676,895

[22] Filed: Nov. 30, 1984

[51] Int. Cl.[4] ..... B65D 5/10

[52] U.S. Cl. ..... 229/39 R; 229/45 R

[58] Field of Search ..... 229/38, 39 R, 44 R, 229/45 R

[56] References Cited

U.S. PATENT DOCUMENTS

| | | | |
|---|---|---|---|
| 262,663 | 8/1882 | Griffiths | 229/39 R |
| 331,800 | 12/1885 | Lockwood | 229/39 R |
| 490,167 | 1/1893 | Schmidt | 229/39 R |
| 932,385 | 8/1909 | Gibson | 229/33 |
| 937,173 | 10/1909 | Pfeiffer | 229/39 R |
| 938,981 | 11/1909 | Cornell | 229/39 R |
| 1,934,312 | 11/1933 | Lambert | 206/44 R |
| 2,017,724 | 10/1935 | Neumann | 229/41 B |
| 2,053,857 | 9/1936 | Weiss | 229/39 R |
| 2,354,098 | 7/1944 | Bamber | 229/16 |
| 2,361,603 | 10/1944 | Cohen et al. | 229/39 R |
| 2,400,443 | 5/1946 | Stopper | 229/39 R |
| 2,762,552 | 9/1956 | Hickin | 229/39 R |
| 3,337,115 | 8/1967 | Jones | 229/39 R |
| 4,279,377 | 7/1981 | Peeples | 229/39 R |
| 4,279,379 | 7/1981 | Lohrbach | 229/39 R |
| 4,347,970 | 9/1982 | Nardone | 229/39 R |
| 4,403,729 | 9/1983 | Wytko | 229/39 R |
| 4,477,017 | 10/1984 | Webinger | 229/39 R |

FOREIGN PATENT DOCUMENTS

| | | | |
|---|---|---|---|
| 218420 | 11/1961 | Austria | 229/39 R |
| 558857 | 6/1958 | Canada | 229/39 R |
| 874638 | 8/1961 | United Kingdom | 229/39 R |

*Primary Examiner*—William Price
*Assistant Examiner*—Gary E. Elkins
*Attorney, Agent, or Firm*—Richard J. Ancel; Robert J. Seman

[57] ABSTRACT

This invention is directed to an improved container made of corrugated paperboard or the like. Appropriately shaped slots in the bottom lock panels permit a fast-locking action without any binding as in conventional containers that are designed for interference fit.

3 Claims, 9 Drawing Figures

BOTTOM SPEED LOCK FOR CONTAINER

BACKGROUND OF THE INVENTION

This invention relates to corrugated paperboard containers, and more particularly to a closure construction for such containers.

Container set-up time and production output are proportionately related; the longer it takes to erect a container, the less will be the line output of a packer. The object being to form a bottom closure arrangement that can be simply and quickly assembled. Conventional containers, such as the container shown in U.S. Pat. No. 4,279,379, are not suitable for fast set-up, as is contemplated by the present invention, because they require an additional step in assembly. After the bottom closure flaps or panels have been correctly positioned relative to one another with the locking tabs inserted in their respective holes, slots, or slits, provided for such engagement, the panels then must be lifted, or pushed from inside the container, by hand to a fully assembled position.

Sometimes, heavy packaging contents provide the necessary force to lock together the bottom panels. However, when packing light items, such as bags of potato chips, additional manual manipulation of the prior art container is required to achieve a completely locked bottom closure.

SUMMARY OF THE INVENTION

It, therefore, is an object of this invention to provide an improved bottom closure construction for a container which will allow rapid assembly to minimize container set-up time.

Appropriately shaped holes or slots in the bottom lock panels permit a fast-locking action without any binding as in conventional containers that are designed for interference fit. When the lock tab "pops" into position, panel tension alone causes the lock to slide into position for a substantially flat bottom ready for packing without additional manipulation by the packer.

Other objects, features and advantages of the present invention will be more fully understood from the following detailed description of a preferred embodiment of the invention, especially when that description is read in conjunction with the accompanying drawings.

DETAILED DESCRIPTION OF THE PREFERRED EMBODIMENT

Figure 1:
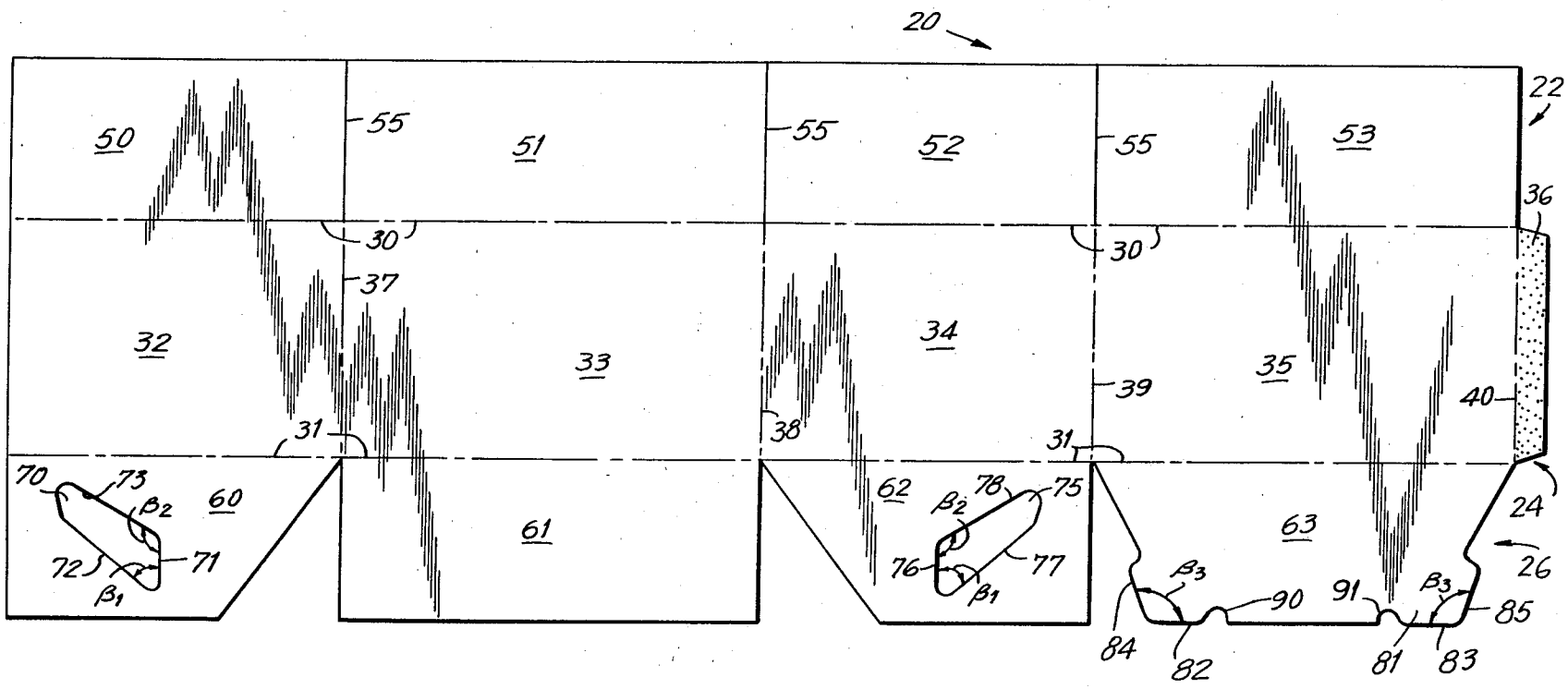
FIG. 1 is a plan view of the cut and scored corrugated paperboard blank from which the container illustrated in FIGS. 2 through 9 is assembled.

Referring now to FIG. 1 of the drawings, the numeral 20 denotes generally the blank of this invention, the blank being formed of a single piece of stiff, foldable and resilient material such as corrugated paperboard. The blank 20 can be divided into three main portions including a top portion 22, a central portion 24, and a bottom portion 26.

The central portion 24 of the blank 20 is comprised of a plurality of body panels between transverse fold lines 30, 31 which become the sides of the container when erected. The central portion 24 includes a first side panel 32, a front panel 33, a second side panel 34, a rear panel 35, and a glue flap 36, conventionally carrying an adhesive, which are foldably connected to one another in series along respective longitudinal fold lines 37, 38, 39, 40.

It should be understood, however, that references in this description to "front", "rear", and "side" are for convenience of description, and such terms are not intended to be used in a limiting way.

The top portion 22 of the blank 20 is comprised of top closure panels 50, 51, 52, 53 foldably connected to, and integral with, upper ends of the panels 32, 33, 34, 35, respectively, along the fold line 30. The top closure panels are separated from their adjacent counterpart by slits 55 to permit them to be independently folded in a conventional manner.

The bottom portion 26 of the blank 20 is comprised of bottom closure panels 60, 61, 62, 63 foldably connected to, and integral with, lower ends of the body panels 32, 33, 34, 35, respectively, along the fold line 31.

Panels 60, 62 form the lock panels of the bottom closure of the container. Each bottom lock panel 60, 62 is foldably connected to a lower end of the non-adjacent body panels 32, 34, respectively, along the fold line 31.

A cut out slot 70 is formed in the bottom lock panel 60 and is comprised of at least three (3) substantially straight edges 71, 72, 73. Still referring to FIG. 1, preferably the first edge 71 of slot 70 is cut relative to a line which is substantially perpendicular to the fold line 31. At one end of first slot edge 71 remote from the fold line 31, the second slot edge 72 is cut so that preferably it is inclined from the first slot edge at an angle $\beta_1$ of approximately 50 degrees. However, it is contemplated that the second slot edge 72 can form an angle between about 46 degrees and about 51 degrees, inclusive, with the first slot edge 71. Preferably, the third slot edge 73, at the other end of first slot edge 71 proximate to the fold line 31, is cut along a line that is inclined from such first slot edge at an angle $\beta_2$ of approximately 120 degrees. However, it is contemplated that the third slot edge 73 can form an angle between about 119 degrees and about 121 degrees, inclusive, with the first slot edge 71.

A cut out slot 75 formed in lock panel 62 also has at least three (3) substantially straight edges 76, 77, 78 which are similarly situated with respect to the fold line 31 and each other, as in the case of edges 71, 72, 73 of the slot 70, because lock panel 62 is a mirror image of lock panel 60.

Preferably, the slots 70, 75 are formed with rounded corners to minimize potential tearing when the lock is put under load.

Panel 61 forms the tuck panel of the bottom closure of the container. It is foldably connected to a lower end of body panel 33, one of the other two (2) non-adjacent body panels 33, 35, along the fold line 31.

Panel 63 forms the tab panel of the bottom closure of the container. It is foldably connected to a lower end of body panel 35 along the fold line 31. The bottom tab panel 63 is formed with a pair of oppositely disposed tabs 80, 81 situated at a free end of the panel. Preferably, each tab 80, 81 is formed with at least two (2) connected, substantially straight edges. Preferably, a first tab edge 82, 83 of tab 80, 81, respectively, is cut relative to a line which is substantially parallel to the fold line 31, while a respective second tab edge 84, 85 is cut so that preferably it is inclined from the first tab edge at an angle $\beta_3$ of approximately 107 degrees. However, it is contemplated that the second tab edge 84, 85 can form an angle between about 103 degrees and about 108 degrees, inclusive, with the first tab edge 82, 83, respectively. (see FIG. 1).

The container is initially formed from the blank 20 by folding body panels 32, 33, 34, 35 about the fold lines 37, 38 39. Then the glue flap 36 is folded about its fold line 40 and is glued to the inner surface of the body panel 32. Clearly, other conventional methods of attaching the flap to the body panel, or of directly attaching body panel 35 to body panel 32, can be used instead of an adhesive. It will be noted that the container as partially assembled up to this point can be folded or collapsed flat for easy shipment and storage. Final assembly of the container is usually performed by the packer.

Figure 2:
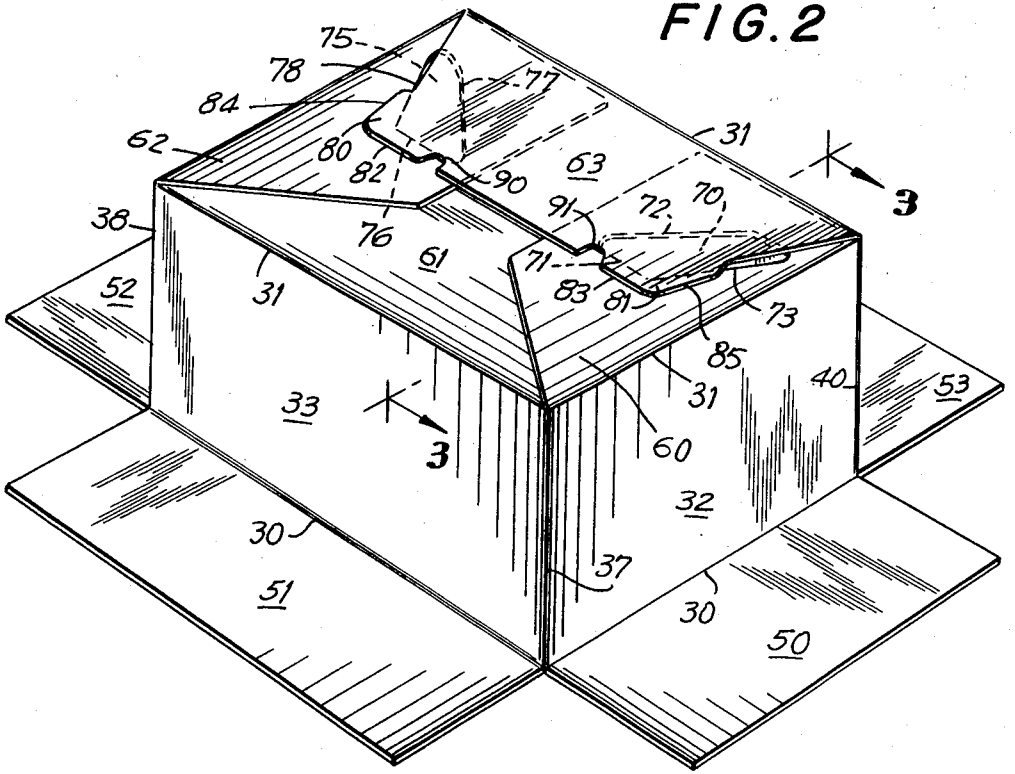
FIG. 2 is a perspective view of the partially assembled container.
Figure 3:
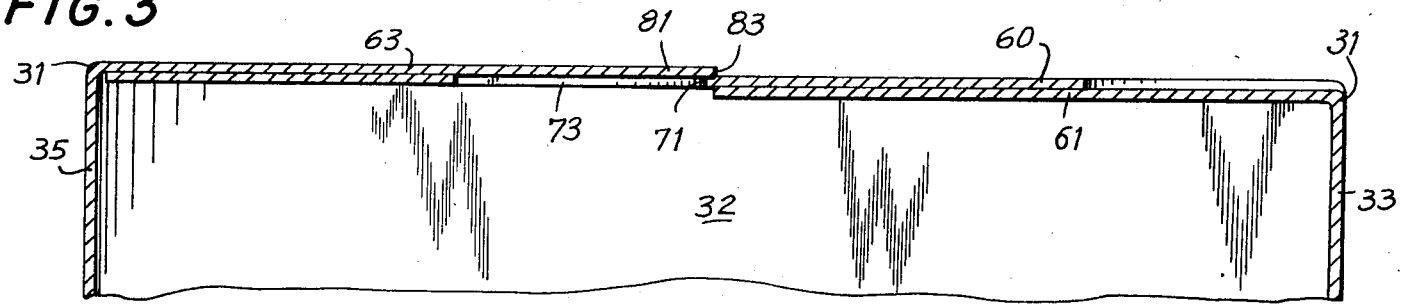
FIG. 3 is an enlarged cross-sectional view taken along line 3—3 of FIG. 2.

At the packing location, the flat container assembly is opened to form a tube, and the top closure panels 50, 51, 52, 53 can be folded outwardly, as shown in FIG. 2, while the bottom closure is formed first. The bottom tuck panel 61 is folded inwardly about fold line 31 until it is substantially perpendicular to the body panels 32, 33, 34, 35. Thereafter, the bottom lock panels 60, 62 are folded inwardly about fold line 31 until they overlie the bottom tuck panel 61, and then bottom tab panel 63 is folded inwardly about fold line 31 until it overlies the bottom lock panels 60, 62 as illustrated in FIG. 2.

Figure 4:
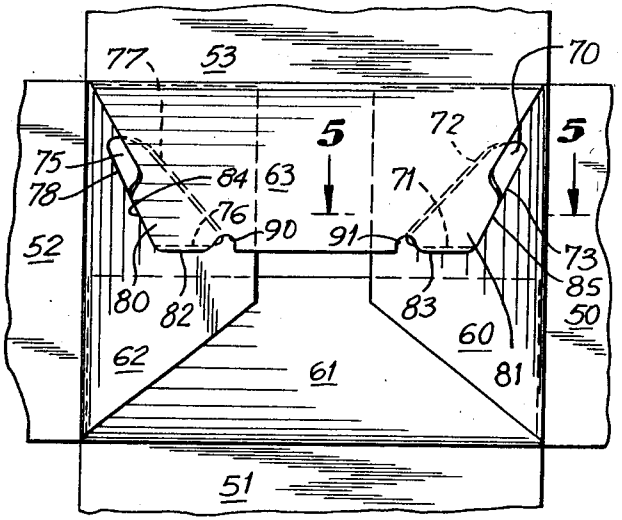
FIGS. 4, 6 and 8 are fragmentary plan views illustrating the container of FIG. 2 in various stages of assembly.
Figure 6:
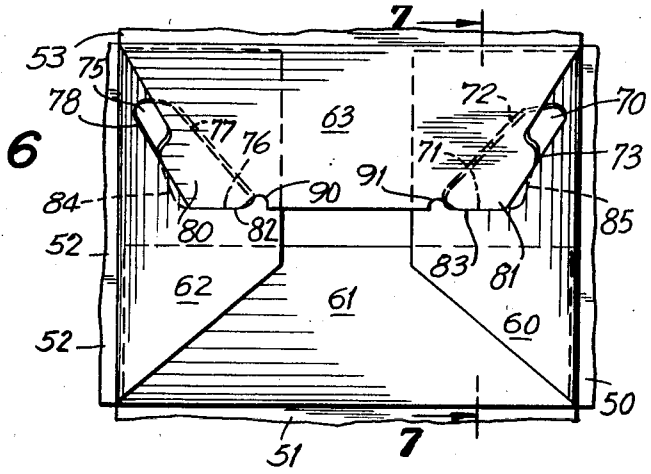
Figure 8:
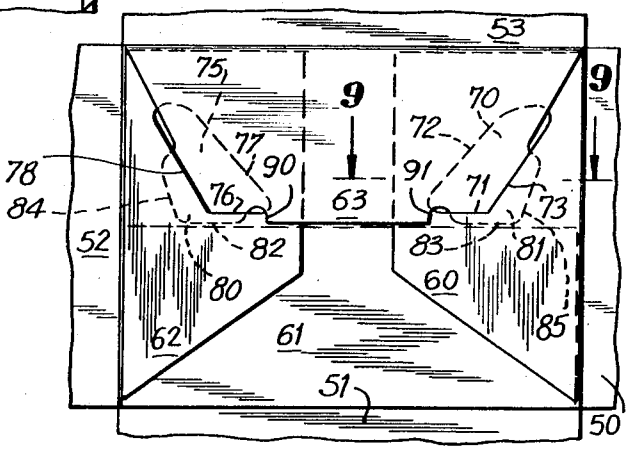
Figure 5:
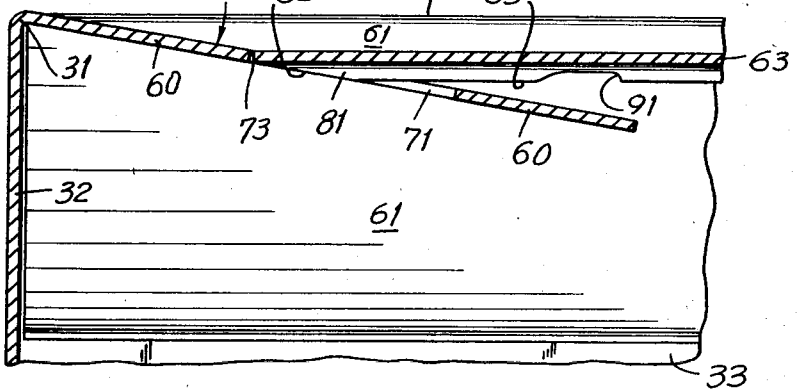
FIG. 5 is an enlarged fragmentary cross-sectional view taken along line 5—5 of FIG. 4.
Figure 7:
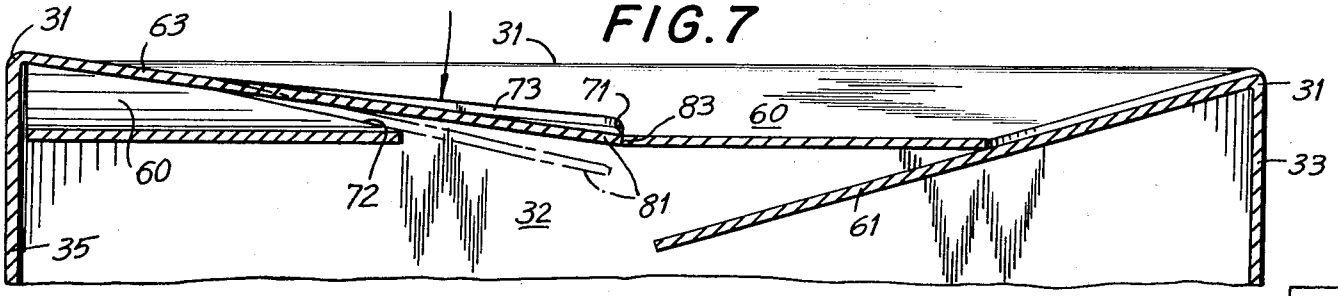
FIG. 7 is an enlarged fragmentary cross-sectional view taken along line 7—7 of FIG. 6.
Figure 9:
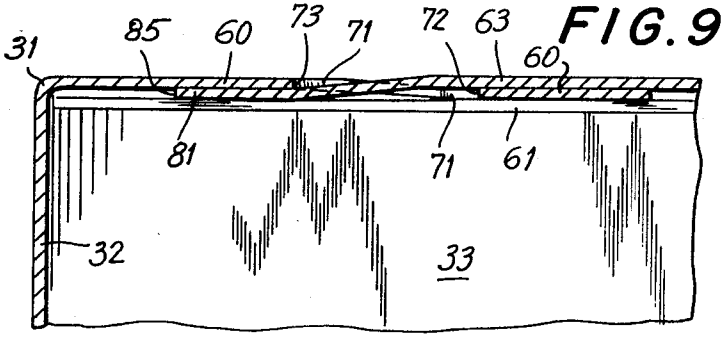
FIG. 9 is an enlarged fragmentary cross-sectional view taken along line 9—9 of FIG. 8.

Referring now to FIG. 4, the bottom tab panel 63 is forced inwardly into the container, thereby also forcing the bottom lock panels 60, 62 into the container interior as tabs 80, 81 slide along the outside surfaces of such lock panels at their respective second tab edges 84, 85. The inwardly moving bottom lock panels 60, 62 force the bottom tuck panel 61 into the container interior as well. As illustrated in FIGS. 4 and 5, the second tab edges 84, 85 are preferably aligned with the third slot edges 73, 78, respectively, at this stage of assembly. Force is continuously applied to the bottom tab panel 63 as the first tab edges 82, 83 unite with the first slot edges 71, 76, respectively, (see FIGS. 6 and 7), and pass by each other without interference until the bottom tab panel 63 comes to rest adjacent the second slot edges 72, 77, as illustrated in FIG. 7 in phantom. There is usually a characteristic "pop" sound that occurs when the respective tab and slot edges clear one another. The appropriately shaped slots 70, 75, particularly the second slot edges 72, 77 thereof ensure that the bottom tab panel 63 is pushed sufficiently far into the container interior so that, when the bottom tab panel is released, tension in the flexed bottom panels causes the lock (slots 70, 75) to slide into position for a substantially flat bottom ready for packing without additional manipulation by the packer. The notches 90, 91, formed in the bottom tab panel 63, allow a greater proportion of the tabs 80, 81 to project into the slots 70, 75, respectively. The engagement of the tabs with the bottom lock panels self-locks the container bottom closure.

While a preferred embodiment of the invention has been shown and described, it should be understood that there may be other container constructions and modifications which fall within the spirit and scope of this invention as defined by the following claims.

What is claimed is:

1. A container comprising:

(a) a plurality of body panels formed of stiff, resilient and foldable sheet material including four side panels serially connected to one another along respective longitudinal fold lines;

(b) a bottom closure including a pair of lock panels, a tuck panel, and a tab panel, each foldably connected to a lower end of a respective one of the body panels along a transverse fold line, each bottom lock panel being connected to one of two non-adjacent body panels, the bottom tuck panel being connected to one of the other two non-adjacent body panels, the bottom tab panel being connected to the remaining body panel, each bottom lock panel having a slot formed with at least three substantially straight edges, the first slot edge being formed relative to a line which is substantially perpendicular to the transverse fold line, the second slot edge being formed at one end of the first slot edge remote from the transverse fold line so that it is inclined from the first slot edge at a first angle of inclination, the third slot edge being formed at the other end of the first slot edge proximate to the transverse fold line so that it is inclined from the first slot edge at a second angle of inclination, the bottom tab panel having a pair of oppositely disposed corner tabs at a free edge thereof, each corner tab defined by indentations along the free edges of the bottom tab panel, each corner tab being formed with at least two connected, substantially straight edges, the first corner tab edge of each tab being formed relative to a line which is substantially parallel to the transverse fold line, the second corner tab edge of each tab being formed so that it is inclined from the first tab edge at a third angle of inclination, each slot cooperatively locking together and receiving a respective one of the corner tabs, each corner tab underlying and spanning said second angle of inclination of its respective slot, each corner tab extending beyond the first slot edge and the third slot edge of its respective slot in a direction away from said respective slot, said tab-defining indentations of each tab being at least partially received by its respective slot.

2. The container of claim 1 wherein the first angle of inclination is between about 46 degrees and about 51 degrees, inclusive, the second angle of inclination is between about 119 degrees and about 121 degrees, inclusive, and the third angle of inclination is between about 103 degrees and about 108 degrees, inclusive.

3. A blank for constructing a container comprising:

(a) a plurality of body panels of stiff, resilient and foldable sheet material including four side panels serially connected to one another along respective longitudinal fold lines;

(b) a bottom closure including a pair of lock panels, a tuck panel, and a tab panel, each foldably connected to a lower end of a respective one of the body panels along a transverse fold line, each bottom lock panel being connected to one of two non-adjacent body panels, the bottom tuck panel being connected to one of the other two non-adjacent body panels, the bottom tab panel being connected to the remaining body panel, each bottom lock panel having a slot in the general shape of a trapezium formed with at least three substantially straight edges, the first slot edge being formed relative to a line which is substantially perpendicular to the transverse fold line, the second slot edge being formed at one end of the first slot edge remote from the transverse fold line so that it is inclined from the first slot edge at an angle of between about 46 degrees and about 51 degrees, inclusive, the third slot edge being formed at the other end of the first slot edge proximate to the transverse fold line so that it is inclined from the first slot edge at an angle of between about 119 degrees and about 121 degrees, inclusive, the bottom tab panel having a pair of oppositely disposed corner tabs at a free edge thereof, each corner tab defined by indentations along the free edges of the bottom tab panel, each tab being formed with at least two connected, substantially straight edges, the first tab edge of each tab being formed so that it is inclined from the first tab edge at an angle of between about 103 degrees and about 108 degrees, inclusive.

* * * * *